United States Patent [19]

Dorward et al.

[11] Patent Number: 4,823,110

[45] Date of Patent: Apr. 18, 1989

[54] TONE GENERATOR WITH IMPROVED DIAPHRAGM MOUNTING

[75] Inventors: Donald Dorward, Pickering; Waldemar A. Hupa, Downsview, both of Canada

[73] Assignee: Magna International Inc., Markham, Canada

[21] Appl. No.: 184,801

[22] Filed: Apr. 22, 1988

[51] Int. Cl.[4] ..... G08B 3/00; G10K 9/00

[52] U.S. Cl. ..... 340/388; 340/384 R; 340/391; 116/142 R; 181/159; 181/160; 181/150; 181/171; 381/188; 381/205

[58] Field of Search ..... 340/388, 384 E, 384 R, 340/391; 181/148, 157, 159, 160, 150, 171, 172, 179; 381/188, 205, 192-201; 116/142 R

[56] References Cited

U.S. PATENT DOCUMENTS

| | | | |
|---|---|---|---|
| 4,183,017 | 1/1980 | Sims | 340/388 |
| 4,286,257 | 8/1981 | Slavin | 340/388 |
| 4,387,788 | 6/1983 | Slavin et al. | 181/148 |
| 4,525,604 | 6/1985 | Frye | 181/159 |

*Primary Examiner*—Donnie L. Crosland

*Attorney, Agent, or Firm*—Cushman, Darby & Cushman

[57] ABSTRACT

A tone generator of the type in which a housing defines a pair of communicating chambers one of which is closed except for an area of communication with the other chamber. A thin flat diaphragm of circular configuration is mounted in an operative position over the area of communication between the chambers in engagement with a flat annular surface defining the same. An annular diaphragm retaining member is mounted in an operative position in superposed relation to the diaphragm in fixedly secured relation within the housing. An improved mounting for the diaphragm is provided which includes a plurality of annularly spaced transversely extending diaphragm engaging lugs formed on the retaining member. The lugs extend in engagement with the diaphragm so that when the retaining member is in its operative position the engagement of the lugs with the diaphragm serves to retain the diaphragm in its operative position. The spacing between the position of engagement of each lug with the diaphragm with respect to the position of engagement of each adjacent lug being such as to accomplish a desirable balance between the amplitude of vibration at self-resonance which decreases as the spacing decreases and the extent of harmonic distortion which increases as the spacing increases.

20 Claims, 3 Drawing Sheets

Fig. 2.
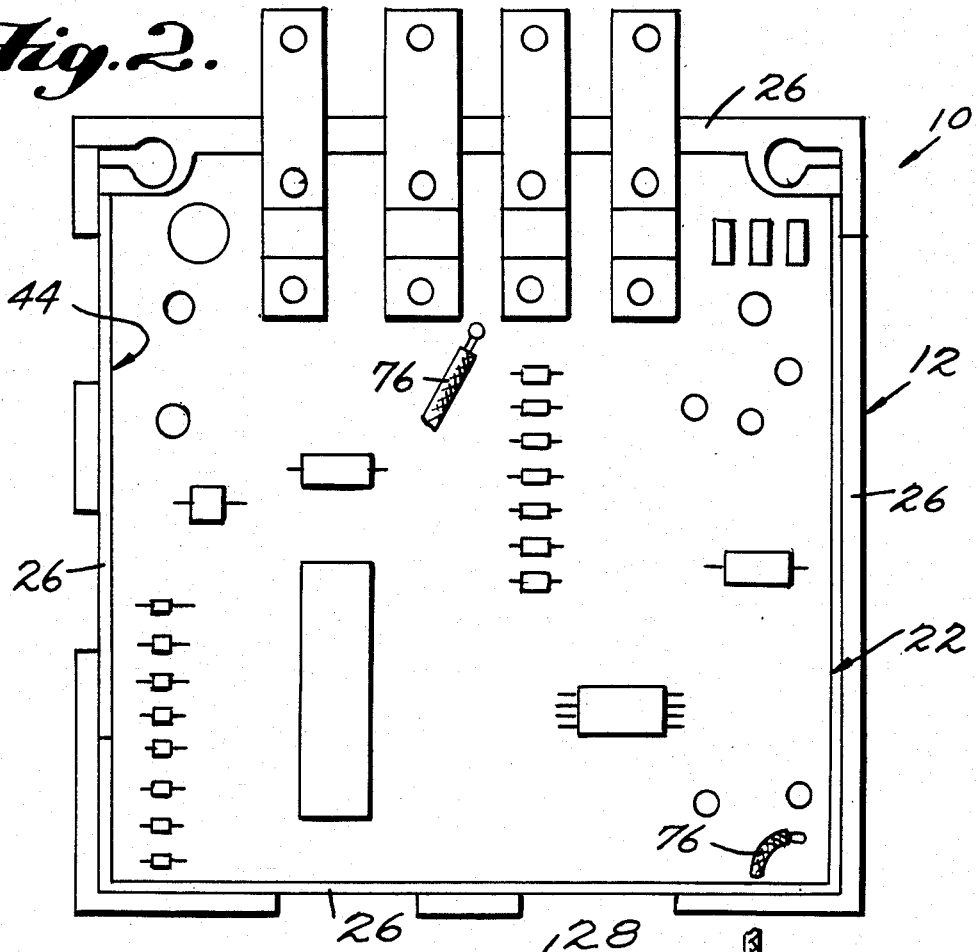
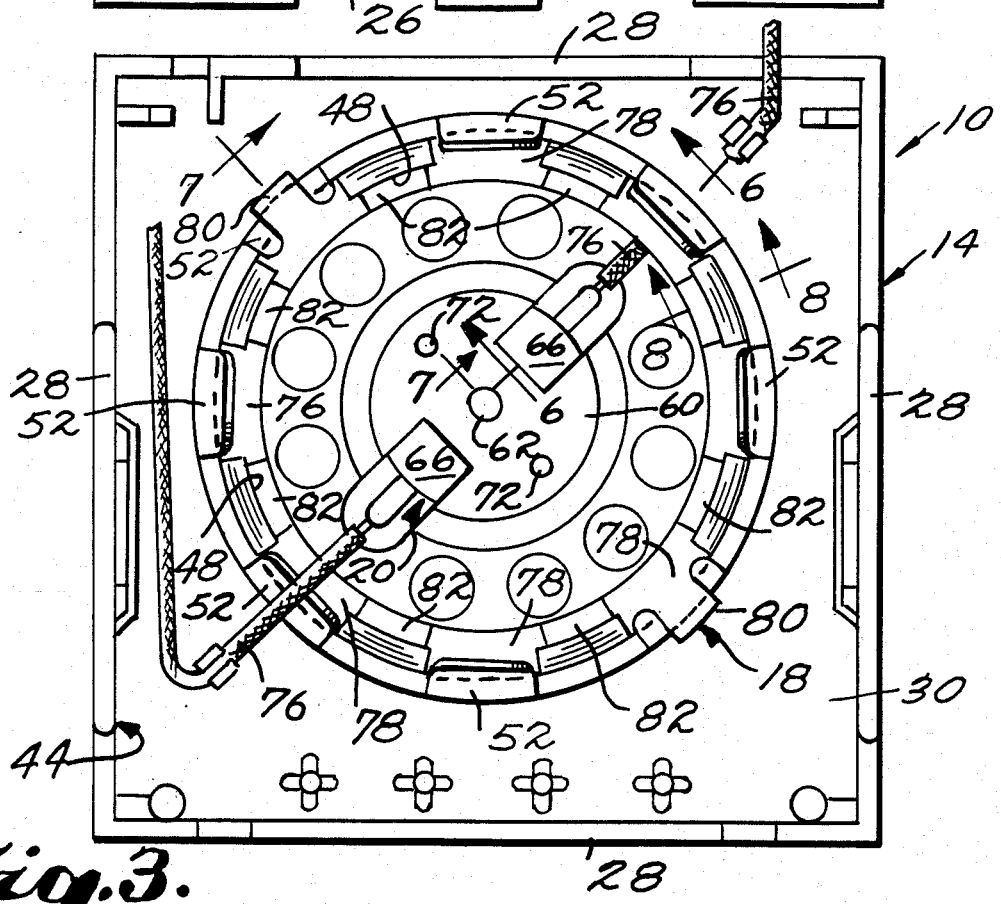
Fig. 3.

Fig. 4.
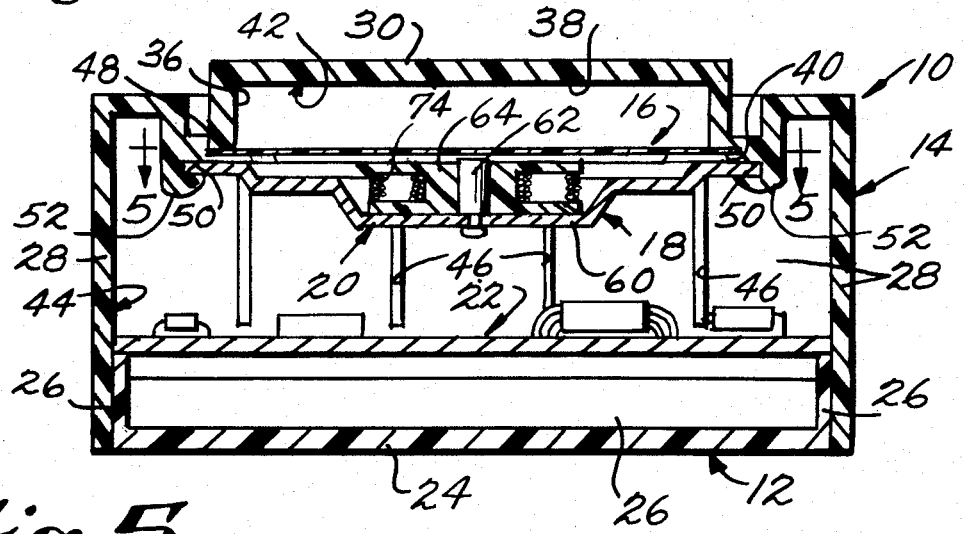
Fig. 5.
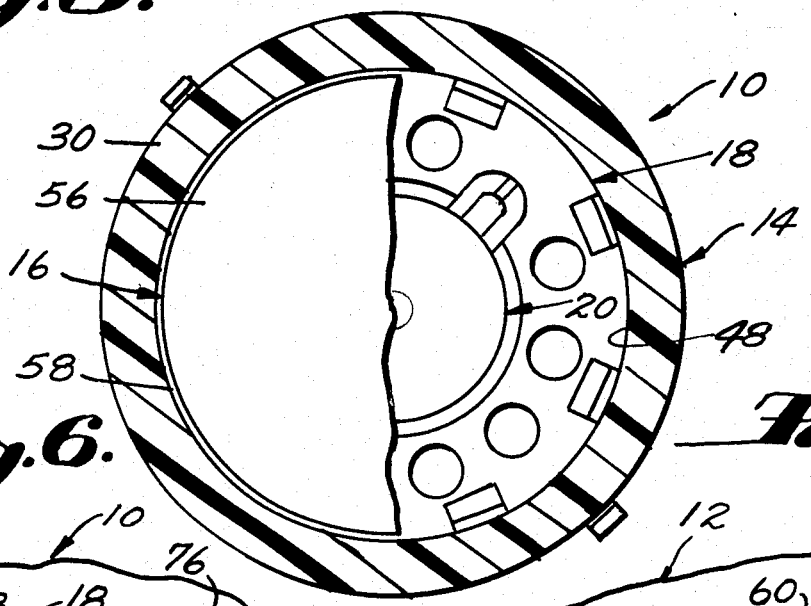
Fig. 6.
Fig. 7.
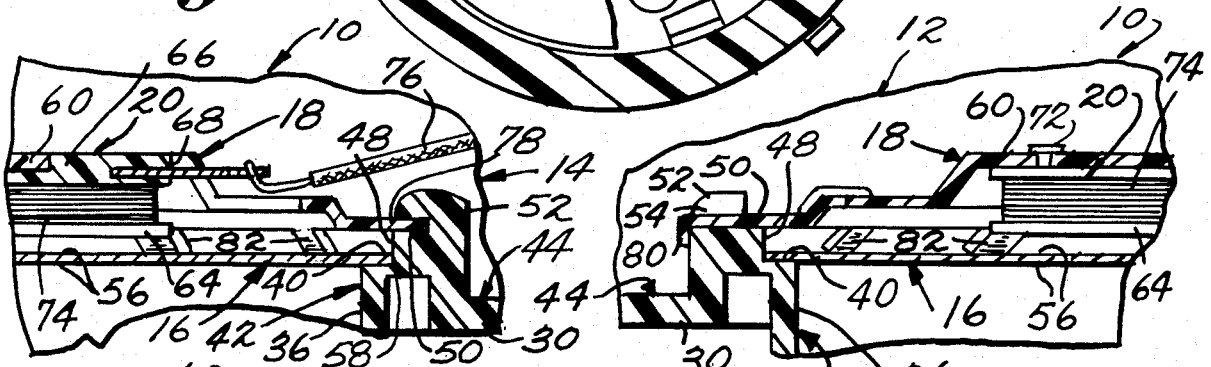
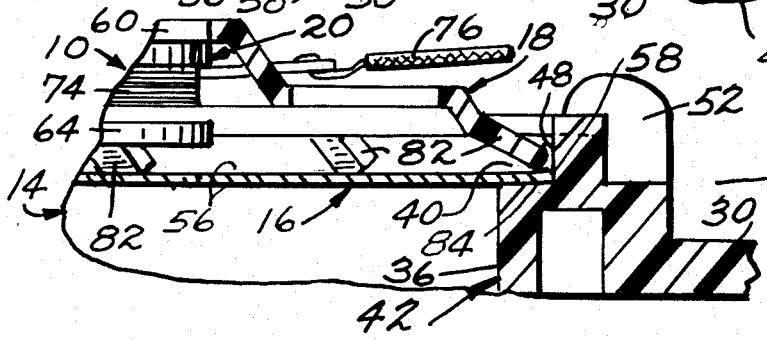
Fig. 8.

TONE GENERATOR WITH IMPROVED DIAPHRAGM MOUNTING

This invention relates to tone generators and, more particularly, to tone generators of the type used in automobiles to signal various conditions as, for example, that the seat belt has not yet been deployed.

An essential operating characteristic of automotive tone generators is that they must be capable of uniformly operating in a stable fashion under diverse conditions of atmospheric pressure and temperature. Moreover, they must also be capable of cost-effective mass production. Existing tone generators utilize an electromagnetic coil and diaphragm assembly essentially as a resonant acoustic transducer for converting an electrical signal into an acoustical signal. Cost effectiveness has heretofore dictated that the circuitry for transmitting the electrical signal to the electromagnetic coil is in the form of a square wave which may vary in duty cycle. The utilization of a square wave as the input electrical signal results in the generation of all of the odd harmonics of the preselected tone frequency. The existence of these harmonics tends to distort the tone unless the manner in which the diaphragm is mounted serves to dampen out the unwanted harmonics to a fair extent. In order to prevent polar cancellation, it is usual practice to mount the diaphragm so that one side is in communication with a closed chamber while the other side is in communication with an open chamber. The necessity to accommodate varying atmospheric pressure conditions requires that the diaphragm be essentially dynamically sealed with respect to the closed chamber but not statically sealed so that a static pressure equalization between the two chambers always exists. The mode of mounting must not only satisfy these differing sealing characteristics but, in addition, must mount the diaphragm so that its vibration amplitude is not so severely restricted as to require the energizing electric circuit to provide excessive power while at the same time providing for the damping out of the unwanted harmonics.

One mode of diaphragm connection in the prior art which has been utilized commercially is to weld the thin metal diaphragm at six equally spaced points adjacent the perimeter of a generally bowl shaped thin metal chamber. A limitation of a construction of this type is that the size of the closed chamber is limited by the size of the metal chamber itself, which in actual practice was relatively small so that it could be soldered to the circuit board as a component thereof. Another construction in the prior art which has been utilized commercially solves the problem of providing a larger closed chamber in a cost effective manner by utilizing a wall of the plastic housing to form the closed chamber and to provide an annular flat mounting surface for engaging one marginal edge surface of the diaphragm. The manner in which the diaphragm is retained in engagement with the mounting surface is to engage a ring of foam rubber with the opposite marginal edge surface of the diaphragm and to additionally provide a retaining member capable of being fixed with respect to the housing part defining the closed chamber and mounting surface.

The utilization of a foam rubber ring presents two problems. First, the foam rubber ring functions to resiliently retain the diaphragm in its operative position and, as such, constitutes essentially a yieldable spring. The nature of the spring, however, is such that its spring rate is severely effected by changes in temperature. For example, where an automobile has been parked outside overnight during winter, the foam rubber ring can approach a virtual frozen condition depending upon how cold it gets. The rigidity thus imparted to the foam rubber ring materially shifts the resonant frequency of the retained diaphragm and thus ultimately detrimentally effects the quality of the desired tone. Second, the foam rubber ring is relatively flexible and capable of being distorted relatively easily. Consequently, handling of the foam rubber ring during assembly requires considerable care in order to insure that the ring is not retained in an unwanted distorted position.

An object of the present invention is the provision of an improved diaphragm mounting arrangement which retains substantially all of the advantages of a foam rubber ring mounting while eliminating the two known disadvantages thereof as noted above. In accordance with the principles of the present invention, the disadvantages are eliminated by eliminating the foam rubber ring from the mounting. The advantages of the foam rubber mounting are secured in accordance with the principles of the present invention by forming on the retaining member a plurality of annularly spaced lugs extending transversely inwardly in engagement with the opposite marginal peripheral edge surface of the diaphragm when the retaining member is in its operative position so that the engagement of the lugs with the diaphragm serves to fixedly retain the diaphragm in its operative position. The spacing between the position of engagement of each lug with the marginal edge surface of the diaphragm with respect to the position of engagement of each adjacent lug being such as to accomplish a desirable balance between the amplitude of vibration at self-resonance which decreases as the spacing decreases and the extent of harmonic distortion which increases as the spacing increases.

Preferably, the retaining member is formed of sheet metal and the annular peripheral portion from which the lugs are formed includes a plurality of spaced annularly extending sections having free edges arcuate about an axis coincident with the circular axis of the diaphragm. Each of the annularly extending sections have a pair of spaced parallel cuts extending inwardly from the associated free end thereof and are bent along a bendline between the inner ends of the cuts so as to form an associated lug which extends angularly from the bendline such that a point on the center of the associated arcuate free edge has the greatest transverse extent and therefore defines a limited area of lug engagement with the diaphragm at the associated position of engagement.

Another object of the present invention is the provision of a tone generator of the type described which is simple in construction, effective in operation and economical to manufacture.

These and other objects of the present invention will become more apparent during the course of the following detailed description and appended claims.

IN THE DRAWINGS

FIG. 2 is a plan view looking toward the interior of one of the housing parts which receives the circuit board assembly;

FIG. 3 is a plan view looking into the interior of the other housing part which receives the diaphragm and electromagnetic coil assembly;

FIG. 4 is a vertical sectional view of the tone generator in assembled condition;

FIG. 5 is a fragmentary sectional view taken along the line 5—5 of FIG. 4;

FIG. 6 is an enlarged fragmentary sectional view taken along the line 6—6 of FIG. 3;

FIG. 7 is an enlarged fragmentary sectional view taken along the line 7—7 of FIG. 3; and FIG. 8 is an enlarged fragmentary sectional view taken along the line 8—8 of FIG. 3.

Figure 1:
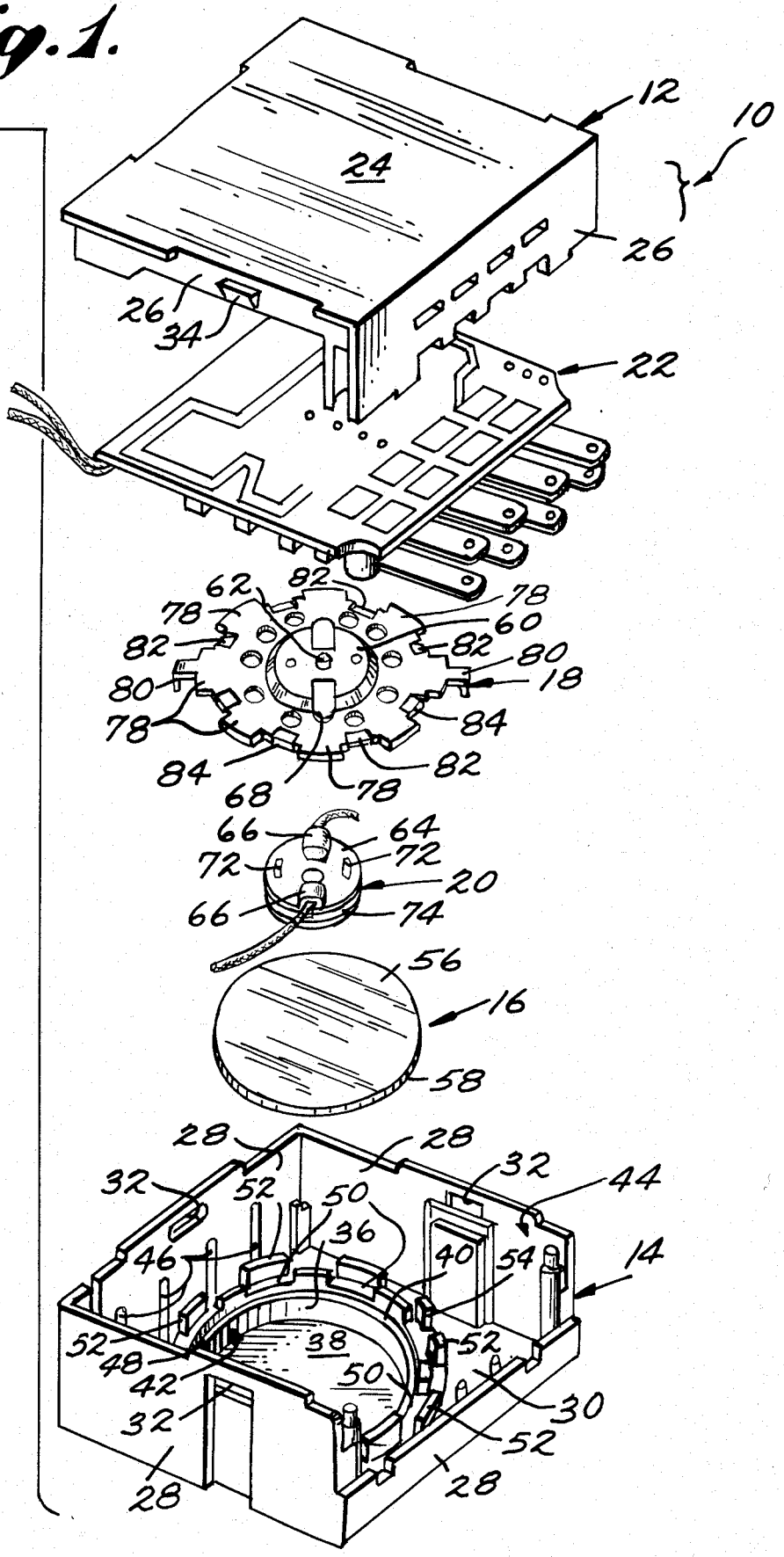
FIG. 1 is an exploded perspective view of the basic component parts of the tone generator embodying the principles of the present invention.

Referring now more particularly to the drawings, there is shown in FIG. 1 an exploded perspective view of the basic components which form a tone generator, generally indicated at 10, embodying the principles of the present invention. The tone generator includes a housing formed of two housing parts, generally indicated at 12 and 14, which are cooperable together to form a hollow boxlike construction. The other components shown in FIG. 1 include a thin metal circular diaphragm, generally indicated at 16, a diaphragm retaining member, generally indicated at 18, an electromagnetic coil assembly, generally indicated at 20, and a circuit board assembly, generally indicated at 22.

The housing part 12 provides an end wall 24 of rectangular or square configuration having peripheral side walls 26 extending therefrom which are configured to receive and support the circuit board assembly 22 as is best shown in FIG. 2. The side walls 26 of the housing part 12 are adapted to cooperate with side walls 28 of the other housing part 14 which likewise includes an end wall 30. As shown, three of the side walls 28 of the housing part 14 are formed with openings 32 and corresponding side walls 26 of the housing part 12 are formed with snap locks 34 for entering the openings and retaining the two housing parts 12 and 14 cooperatively together in operative position.

The end wall 30 of the housing part 14 has formed on the interior thereof a cylindrical wall surface 36 which extends in a direction inwardly from a cylindrical interior surface 38 and intersects with a flat radially outwardly extending diaphragm engaging surface 40. The cylindrical wall surface 36 and associated surface 38 define a closed chamber, generally indicated at 42, which communicates with an open chamber, generally indicated at 44, except at an area of communication therewith which is defined by the inner periphery of the annular flat surface 40. The open chamber 44 is defined by the remainder of the interior surfaces of the two housing parts and is open as by slots 46 in a side wall 28 of the housing part 14.

Extending from the exterior periphery of the flat diaphragm receiving surface 40 is a second cylindrical wall surface 48. Extending radially outwardly from the upper edge of the cylindrical wall is a plurality of annularly spaced radially extending surfaces 50. Formed outwardly of each of the mounting surfaces 50 is a pad 52. Two of the diammetrically opposed pads 52 are formed with a radially extending groove 54 therein for orientation purposes.

The surfaces 40 and 48 in the end wall 30 described above are provided for the purpose of receiving the diaphragm 16. The diaphragm 16 is of circular configuration and includes opposed flat surfaces 56, the marginal peripheral edge portions of which serve to define a peripheral edge 58. The diaphragm is mounted in its operative position with one of the peripheral marginal edge surfaces 56 disposed in engagement with the flat annular surface 50 and with the peripheral edge 58 spaced closely adjacent the cylindrical wall surface 48. With reference to FIG. 8, the diaphragm 16 is shown therein in somewhat exaggerated scale as having a bead or sharp edge on one surface 56 of the edge 58. A bead or sharp edge similar to that shown but of less dimension is inherently formed when the diaphragm 16 is punched out of a sheet of metal. It is greatly preferred that the bead or sharp edge be directed away from the mounting surface 40, as shown in FIG. 8. Where the diaphragm 16 is mounted such that the bead is in engagement with the mounting surface 40, there is a tendency due to the fixed mounting of the diaphragm for the bead to dig into the plastic material defining the surface 40 and form an undesirable static seal therewith.

The retaining member 18 is preferably stamped from sheet metal to include a recessed central portion 60 which is centrally apertured to receive a metallic pole pin 62 which is fixed with respect thereto and extends in a direction away from the concave side of the recessed portion 60. Preferably, the electromagnetic coil assembly 20 is mounted within the concave side of the recessed portion 60. As shown, the coil assembly 20 includes a plastic spool 64 centrally apertured to receive the pole pin 62. One side of the spool 64 includes a pair of spaced projecting terminal portions 66 which are adapted to extend through a pair of openings 68 formed in the recessed portion 60 of the retaining member 18. The side of the spool 64 also includes a pair of upwardly extending mounting pins 72 integral with the associated side wall which extends through suitable openings in the recessed portion 60 of the retaining member 18. As best shown in FIG. 7, the ends of the pins 72 are fused over the adjacent convex side of the recessed portion 60 to retain the electromagnetic coil assembly 20 in operative position within the recessed portion. It will be understood that the spool 64 has a wire winding 74 thereon which is electrically connected with a pair of lead wires 76 extending from the terminal portions 66.

The periphery of the retaining member 18 is notched to provide a plurality of radially outwardly extending mounting sections 78. Formed outwardly from a diammetrically opposed pair of mounting sections 78 are a pair of L-shaped orienting tabs 80. In accordance with the principles of the present invention, the retaining member 18 has formed in the annular portion disposed radially inwardly of the mounting sections 78 at positions between the mounting sections 78 a plurality of annularly spaced lugs 82. Each lug 82 is formed by a pair of parallel cuts extending inwardly from a peripheral edge 84 arcuate about the center of the recessed portion 60. Each lug 82 is bent angularly along a bendline extending straight between the inner ends of the cuts so that a central portion of the arcuate free edge 84 extends laterally to a greater extent than the remaining portion of the edge 84.

The retaining member 18 with the attached electromagnetic coil assembly 20 is mounted in an operative position within the housing part 14 wherein the mounting sections 78 engage the mounting surfaces 50 with the orienting tabs 80 extending with the grooves 54. In addition, the retaining member 18 is oriented so that the convex side of the central recessed portion 60 faces toward the open chamber 44 so that the free end of the pole pin 62 facing in the opposite direction is spaced closely adjacent the central area of a surface 56 of the diaphragm 16. With this orientation, the central points of the outer edges 84 of the lugs 82 engage the associated peripheral marginal edge surface 56 of the diaphragm 16 when the retaining member 18 is in its operative position. It will be understood that the retaining member 18 is fixed in its operative position by fusing the pads 52 over the adjacent surfaces of the retaining member 18 which face inwardly toward the open chamber 44.

It will be understood that, rather than to have the lugs 82 engage the diaphragm at very limited areas which approach point contact, the lugs 82 could engage the diaphragm along annular lines or at two or more annularly spaced points. In accordance with the principles of the present invention, the spacing of adjacent points of contact between adjacent lugs is important. Preferably, this spacing should be less than 100% of the diaphragm radius and more than 35% of the diaphragm radius. Preferably, the spacing is less than 86% of the diaphragm radius and more than 61%. In the eight lug embodiment shown, the distance between adjacent points is approximately 70% of the diaphragm radius. With this spacing, there is obtained a desired balance between the extent of predetermined frequency self-resonance which decreases as the spacing decreases and the extent of harmonic distortion which increases as the spacing increases.

With respect to the circuit board assembly 22, it will be understood that any suitable circuit may be utilized. Merely for exemplary purposes, reference is made to the circuit disclosed in U.S. Pat. Nos. 4,286,257 and 4,183,278, the disclosures of which is hereby incorporated by reference into the present specification. The circuit is of the type which produces an electrical signal of a predetermined frequency which is of square form, the square wave form varying in duty cycle. With the utilization of such circuitry, the vibration imparted to the diaphragm 16 will include not only the predetermined frequency to which the closed chamber 42 is tuned but all odd harmonics thereof as well. The spaced fixed or rigid mounting of the periphery of the diaphragm 16 by the lugs 82 enables the central portion of the diaphragm 16 to vibrate with a highly desirable amplitude with the utilization of power requirements which maintain cost effectiveness. It will be understood that, as the spacing between the points of contact decrease to zero which would constitute a totally rigid mounting, the vibratory amplitude of the center of the diaphragm would be materially decreased necessitating a substantial increase in the power requirements which is costly to provide. On the other hand, with the spacing provided, the frequency of unwanted harmonics which can occur between the peripheral portions of the diaphragm 16 between the points of contact are of high frequency which are more readily damped out.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. In a tone generator comprising a housing having means therein defining a pair of communicating chambers one of which is closed except for an area of communication with the other chamber, said chamber defining means including an annular flat surface having an inner periphery defining the area of communication of said one chamber with said other chamber and wall means extending from the outer periphery thereof in a direction away from said one chamber, a thin flat diaphragm of circular configuration having opposed outer peripheral marginal edge surfaces defining a thin outer peripheral edge, said diaphragm being mounted in an operative position over the area of communication between said one chamber and the other chamber with one marginal peripheral edge surface in engagement with said flat annular surface and with said peripheral edge in closely spaced relation with respect to said wall means, an annular diaphragm retaining member mounted in an operative position in superposed relation to said diaphragm, means for fixedly securing said retaining member in its operative position, electromagnetic coil means for causing said diaphragm to vibrate for tone generation purposes, and circuit means for energizing said electromagnetic coil means to cause said diaphragm to vibrate for tone generating purposes, the improvement which comprises said retaining member having a plurality of annularly spaced transversely extending diaphragm engaging lugs formed on an annular peripheral portion thereof, said lugs extending transversely inwardly of said wall means in engagement with the opposite marginal peripheral edge surface of said diaphragm when said retaining member is in its operative position so that the engagement of said lugs with said diaphragm serves to retain said diaphragm in its operative position, the spacing between the position of engagement of each lug with said marginal edge surface of said diaphragm with respect to the position of engagement of each adjacent lug being such as to accomplish a desirable balance between the amplitude of vibration at self-resonance which decreases as the spacing decreases and the extent of harmonic distortion which increases as the spacing increases.

2. The improvement as defined in claim 1 wherein said retaining member is formed of sheet metal and the annular peripheral portion from which said lugs are formed includes a plurality of spaced annularly extending sections having free edges arcuate about an axis coincident with the circular axis of said diaphragm, each of said annularly extending sections having a pair of spaced parallel cuts extending inwardly from the associated free end thereof and being bent along a bend-line between the inner ends of said cuts so as to form an associated lug which extends angularly from said bend-line such that a point on the center of the associated arcuate free edge has the greatest transverse extent and therefore defines a limited area of lug engagement with said diaphragm at the associated position of engagement.

3. The improvement as defined in claim 2 wherein said diaphragm is stamped from sheet metal so as to form a burr along the junction between the peripheral edge and one peripheral marginal edge surface thereof, said diaphragm having the other peripheral marginal edge surface engaged with said flat annular surface.

4. The improvement as defined in claim 3 wherein the positions of engagement of said lugs with said diaphragm are equally annularly spaced with respect to one another, the spacing between adjacent positions of lug engagement being less than 100% of the diaphragm radius and more than 35% of the diaphragm radius.

5. The improvement as defined in claim 4 wherein the spacing between adjacent positions of lug engagement is less than 66% of the diaphragm radius and more than 61% of the diaphragm radius.

6. The improvement as defined in claim 5 wherein the spacing between adjacent positions of lug engagement is approximately 70% of the diaphragm radius.

7. The improvement as defined in claim 1 wherein said diaphragm is stamped from sheet metal so as to form a burr along the junction between the peripheral edge and one peripheral marginal edge surface thereof, said diaphragm having the other peripheral marginal edge surface engaged with said flat annular surface.

8. The improvement as defined in claim 1 wherein the positions of engagement of said lugs with said diaphragm are equally annularly spaced with respect to one another, the spacing between adjacent positions of lug engagement being less than 100% of the diaphragm radius and more than 35% of the diaphragm radius.

9. The improvement as defined in claim 8 wherein the spacing between adjacent positions of lug engagement is less than 66% of the diaphragm radius and more than 61% of the diaphragm radius.

10. The improvement as defined in claim 9 wherein the spacing between adjacent positions of lug engagement is approximately 70% of the diaphragm radius.

11. In a tone generator comprising a housing including two cooperating housing parts of thermoplastic material operable when disposed in cooperating relation to define a hollow boxlike configuration having opposed end walls interconnected by peripheral wall means, one of said end walls having (1) interior surfaces defining a closed chamber except for an area of communication with the interior of said housing constituting an open chamber (2) a flat circular surface defining the area of communication of said closed chamber at the inner periphery thereof, (3) a cylindrical wall surface extending from the outer periphery of said flat circular surface in a direction into said open chamber, (4) a plurality of annularly spaced flat mounting surfaces extending radially outwardly from said cylindrical wall surface, and (5) a plurality of annularly spaced pads extending into said open chamber and disposed in annularly spaced relation radially outwardly of said mounting surfaces, at least one of said pads having an orienting groove extending radially therethrough, a thin flat metal diaphragm of circular configuration having opposed outer peripheral marginal edge surfaces defining a thin outer peripheral edge, said diaphragm being mounted in an operative position over the area of communication between said closed chamber and the open chamber with one marginal peripheral edge surface in engagement with said flat circular surface and with said peripheral edge in closely spaced relation with respect to said cylindrical wall surface, an annular diaphragm retaining member of sheet metal mounted in an operative position in superposed relation to said diaphragm, said retaining member having (1) a plurality of annularly spaced mounting sections engaging said flat mounting surfaces when said retaining member is in said operative position, (2) a radially extending orienting tab disposed in said orienting groove when said retaining member is disposed in said operative position, (3) a central recessed portion having a concave side facing toward said closed chamber and a convex side facing toward said open chamber when said retaining member is disposed in said operative position, and (4) an annular peripheral portion disposed radially inwardly of said mounting sections and radially outwardly of said central recessed portion, said pads being fused over said mounting sections to fix said retaining member in said operative position, a metal core pin fixed to the center of said recessed portion and extending toward said diaphragm and terminating in closely spaced relation thereto, an electromagnetic coil assembly fixed within the concave side of said recessed portion in surrounding relation to said metal core pin and circuit means for energizing said electromagnetic coil means to cause said diaphragm to vibrate for tone generating purposes, the improvement which comprises said retaining member having a plurality of annularly spaced transversely extending diaphragm engaging lugs formed from said annular peripheral portion thereof, said lugs extending transversely inwardly of said cylindrical wall surface in engagement with the opposite marginal peripheral edge surface of said diaphragm when said retaining member is in its operative position so that the engagement of said lugs with said diaphragm serves to retain said diaphragm in its operative position, the spacing between the position of engagement of each lug with said marginal edge surface of said diaphragm with respect to the position of engagement of each adjacent lug being such as to accomplish a desirable balance between the amplitude of vibration at self-resonance which decreases as the spacing decreases and the extent of harmonic distortion which increases as the spacing increases.

12. The improvement as defined in claim 11 wherein said annular peripheral portion includes a plurality of spaced annularly extending sections having free edges arcuate about an axis coincident with the circular axis of said diaphragm, each of said annularly extending sections having a pair of spaced parallel cuts extending inwardly from the associated free end thereof and being bent along a bendline between the inner ends of said cuts so as to form an associated lug which extends angularly from said bendline such that a point on the center of the associated arcuate free edge has the greatest transverse extent and therefore defines a limited area of lug engagement with said diaphragm at the associated position of engagement.

13. The improvement as defined in claim 12 wherein said diaphragm is stamped from sheet metal so as to form a burr along the junction between the peripheral edge and one peripheral marginal edge surface thereof, said diaphragm having the other peripheral marginal edge surface engaged with said flat annular surface.

14. The improvement as defined in claim 13 wherein the positions of engagement of said lugs with said diaphragm are equally annularly spaced with respect to one another, the spacing between adjacent positions of lug engagement being less than 100% of the diaphragm radius and more than 35% of the diaphragm radius.

15. The improvement as defined in claim 14 wherein the spacing between adjacent positions of lug engagement is less than 66% of the diaphragm radius and more than 61% of the diaphragm radius.

16. The improvement as defined in claim 15 wherein the spacing between adjacent positions of lug engagement is approximately 70% of the diaphragm radius.

17. The improvement as defined in claim 11 wherein the positions of engagement of said lugs with said diaphragm are equally annularly spaced with respect to one another, the spacing between adjacent positions of lug engagement being less than 100% of the diaphragm radius and more than 35% of the diaphragm radius.

18. The improvement as defined in claim 17 wherein the spacing between adjacent positions of lug engagement is less than 66% of the diaphragm radius and more than 61% of the diaphragm radius.

19. The improvement as defined in claim 18 wherein the spacing between adjacent positions of lug engagement is approximately 70% of the diaphragm radius.

20. The improvement as defined in claim 11 wherein said diaphragm is stamped from sheet metal so as to form a burr along the junction between the peripheral edge and one peripheral marginal edge surface thereof, said diaphragm having the other peripheral marginal edge surface engaged with said flat annular surface.

* * * * *